US010144572B2

(12) United States Patent
Springhorn

(10) Patent No.: US 10,144,572 B2
(45) Date of Patent: Dec. 4, 2018

(54) DUAL FLUID CARTRIDGE ASSEMBLY

(71) Applicant: NORDSON CORPORATION, Westlake, OH (US)

(72) Inventor: Robert W. Springhorn, Cream Ridge, NJ (US)

(73) Assignee: Nordson Corporation, Westlake, OH (US)

( * ) Notice: Subject to any disclaimer, the term of this patent is extended or adjusted under 35 U.S.C. 154(b) by 0 days.

(21) Appl. No.: 15/880,550

(22) Filed: Jan. 26, 2018

(65) Prior Publication Data

US 2018/0215524 A1 Aug. 2, 2018

Related U.S. Application Data

(60) Provisional application No. 62/453,731, filed on Feb. 2, 2017.

(51) Int. Cl.

| | |
|---|---|
| ***B65D 81/32*** | (2006.01) |
| ***B05C 17/005*** | (2006.01) |
| ***B05C 17/01*** | (2006.01) |

(52) U.S. Cl.

CPC ..... *B65D 81/325* (2013.01); *B05C 17/00559* (2013.01); *B05C 17/00596* (2013.01); *B05C 17/0123* (2013.01)

(58) Field of Classification Search

CPC ..... B65D 81/325; B05C 17/00559; B05C 17/00596; B05C 17/0123

USPC ..... 222/136

See application file for complete search history.

(56) References Cited

U.S. PATENT DOCUMENTS

| | | | | |
|---|---|---|---|---|
| 4,220,261 | A | 9/1980 | White | |
| 4,676,406 | A * | 6/1987 | Frischmann | B01F 11/0082 16/225 |
| 4,961,250 | A | 10/1990 | Calavenna | |
| 5,076,470 | A | 12/1991 | Hatakeyama et al. | |
| 5,295,613 | A * | 3/1994 | Barthomeuf | B05C 17/00516 222/137 |
| 5,301,842 | A | 4/1994 | Ritter | |
| 5,310,091 | A * | 5/1994 | Dunning | B65D 81/325 222/135 |
| 5,647,510 | A * | 7/1997 | Keller | B05C 17/00513 222/94 |
| 7,506,783 | B2 | 3/2009 | Brennan et al. | |

(Continued)

FOREIGN PATENT DOCUMENTS

| | | |
|---|---|---|
| EP | 2384883 A1 | 11/2011 |
| WO | 03/50012 A1 | 6/2003 |

OTHER PUBLICATIONS

ISA/220—Notification of Transmittal of Search Report and Written Opinion of the ISA, or the Declaration dated Jun. 5, 2018 for WO Application No. PCT/US18/015367.

*Primary Examiner* — Benjamin R Shaw

(74) *Attorney, Agent, or Firm* — Baker & Hostetler LLP

(57) ABSTRACT

A dual fluid cartridge assembly includes a cartridge, a flange, and a piston tube. The cartridge defines a channel and includes an flange. The flange defines a cavity that extends from a cavity opening to a cavity base. The cavity opening is positioned within the channel of the cartridge, and the cavity base is positioned external to the cartridge. The piston tube has an extended end, and is positioned at least partially within the channel. The extended end is positioned within the cavity.

21 Claims, 8 Drawing Sheets

(56) References Cited

U.S. PATENT DOCUMENTS

| | | | | |
|---|---|---|---|---|
| 2006/0144858 | A1* | 7/2006 | Brennan | B05C 17/00553 222/137 |
| 2006/0151530 | A1* | 7/2006 | Horner | B05C 17/00559 222/137 |
| 2012/0104044 | A1 | 5/2012 | Pappalardo | |
| 2013/0161352 | A1* | 6/2013 | Bodet | B05B 11/0048 222/135 |
| 2014/0008391 | A1* | 1/2014 | Lin | B65D 81/325 222/136 |

* cited by examiner

DUAL FLUID CARTRIDGE ASSEMBLY

CROSS REFERENCE TO RELATED APPLICATIONS

This application claims the benefit of U.S. Provisional Patent App. No. 62/453,731, filed Feb. 2, 2017, the disclosure of which is hereby incorporated by reference herein.

TECHNICAL FIELD

This disclosure relates generally to a dual fluid cartridge assembly and, more particularly, to a system and method for connecting a piston seal and delivery tube within a dual fluid cartridge assembly.

BACKGROUND

Single and multiple fluid cartridge assemblies are generally known to dispense fluid materials, such as reactive adhesives, which typically contain two components that need to remain separated and applied quickly after mixing. An example of a single fluid cartridge assembly is disclosed in commonly owned international patent application No. PCT/US02/39041, filed on Dec. 6, 2002. Examples of multiple fluid cartridge assemblies are disclosed in, for example, U.S. Pat. Nos. 4,220,261, 4,961,250, and 5,310,091.

In U.S. Pat. No. 5,310,091, a dual fluid cartridge includes a front and a rear chamber formed by an outer cartridge and an inner cartridge, respectively. Piston seals are used to separate the fluids within the cartridges. Movement of the inner cartridge under the influence of a plunger causes the inner cartridge and upper piston to advance axially within the outer cartridge. The inner cartridge is in fluid communication with a piston tube, which extends through a front chamber up to a cartridge outlet. Movement of the inner cartridge within the outer cartridge causes the fluids in the inner cartridge and the outer cartridge to be dispensed. To fill the inner cartridge chamber and the outer cartridge chamber with the fluids, the fluids are forced into the cartridge outlet forcing the inner cartridge and the upper piston to retract axially within the outer cartridge.

During the process to fill the inner cartridge chamber and the outer cartridge chamber with fluid, a force is provided to the piston tube that can cause the piston tube to detach from the outer cartridge. Although the risk of detachment is generally low, the severity of the problem caused can be very high. In conventional systems, detecting whether the piston tube has detached from the outer cartridge is difficult, and may include, for example, an air pressure test or a destructive analysis. The air pressure test involves checking the pressure of air in the outer cartridge chamber and in the inner cartridge chamber for air pressure decay discretely, and then checking the two chambers for air pressure decay together. If both of the chambers exhibit large pressure decay discretely, and neither of the chambers exhibit large pressure decay together, it is an indication that the piston tube has detached from the cartridge assembly. However, the air pressure test can be time consuming and expensive, and requires the appropriate testing equipment. The destructive analysis involves disassembling or destroying the fluid cartridge, which can render the fluid cartridge non-operational.

Therefore, there is a need for an improved system and method for filling and dispensing fluids from a cartridge assembly, and for detecting whether the piston tube has detached from the outer cartridge

SUMMARY

The foregoing needs are met, to a great extent, by the dual fluid cartridge assembly disclosed in the present application. The dual fluid cartridge assembly includes an outer cartridge and a piston tube. The outer cartridge extends in an axial direction from a proximal end to a distal end. The outer cartridge includes a base wall having an inner edge and a flange. The base wall is positioned toward the distal end of the outer cartridge. The flange extends at least partially along the inner edge of the base wall and defines a cavity that extends in the axial direction from a cavity opening to a cavity base. The cavity base is distal to the base wall in the axial direction. The piston tube has an extended end that is positioned within the cavity.

An alternative aspect of the dual fluid cartridge assembly includes an outer cartridge and a piston tube. The outer cartridge includes a base wall and a flange. The base wall has an inner edge that defines a cartridge outlet. The flange extends at least partially along the inner edge of the base wall and defines a cavity that extends in an axial direction from a cavity opening to a cavity base. The base wall is distal to the cavity opening in the axial direction, and the cavity base is distal to the base wall in the axial direction. The piston tube has an extended end positioned within the cavity.

An alternative aspect of the dual fluid cartridge assembly includes a cartridge defining a channel, a flange, and a piston tube. The flange is coupled to the cartridge and defines a cavity that extends from a cavity opening to a cavity base. The cavity opening is positioned within the channel of the cartridge, and the cavity base is positioned external to the cartridge. The piston tube is positioned at least partially within the channel. The piston tube has an extended end that is positioned within the cavity.

Another aspect of a dual fluid cartridge assembly includes an outer cartridge, an upper seal, an inner cartridge, and a piston tube. The outer cartridge carries a first fluid and includes a cylindrical outer wall, a base wall, and a flange. The cylindrical wall defines a channel. The base wall has an inner edge that defines a cartridge outlet. The flange extends at least partially along the inner edge of the base wall and defines a cavity that extends in an axial direction from a cavity opening to a cavity base. The base wall is distal to the cavity opening in the axial direction, and the cavity base is distal to the base wall in the axial direction. The upper seal is positioned within the channel and configured to seal the first fluid in said outer cartridge. The inner cartridge carries a second fluid. The piston tube is positioned at least partially within the channel. The piston tube has an extended end that is positioned within the cavity. The piston tube is configured to provide a fluid flow path from said inner cartridge to said cartridge outlet.

BRIEF DESCRIPTION OF THE DRAWINGS

The foregoing summary, as well as the following detailed description of illustrative embodiments of the present application, will be better understood when read in conjunction with the appended drawings. For the purposes of illustrating the present application, there is shown in the drawings illustrative embodiments of the disclosure. It should be understood, however, that the application is not limited to the precise arrangements and instrumentalities shown. In the drawings.

DETAILED DESCRIPTION

Figure 1:
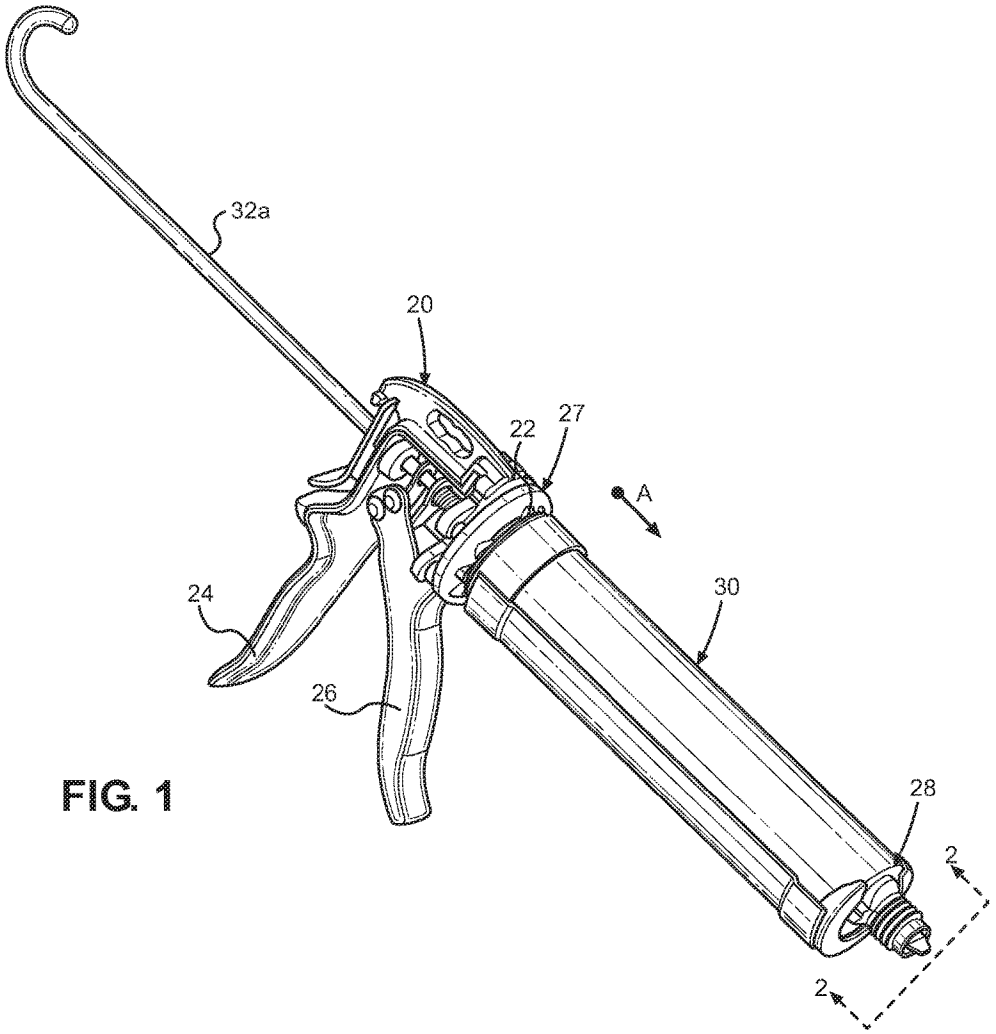
FIG. 1 illustrates a perspective view of a dual fluid cartridge assembly.

A dual fluid cartridge assembly for carrying two separate fluids, such as a resin and a hardener separately, is disclosed. The cartridge assembly can mate with a conventional mixing nozzle to enable the mixed fluids to be applied to a work piece by way of a standard dispensing device, e.g., a caulking gun. The cartridge assembly reduces the risk of components detaching or breaking during operation with improved interfaces between components and improved detectability of failure.

Certain terminology used in this description is for convenience only and is not limiting. The words "proximal" and "distal" generally refer to positions or directions toward and away from, respectively, an individual operating a cartridge assembly. The words "axial," "radial," and "transverse" designate directions in the drawings to which reference is made. The term "substantially" is intended to mean considerable in extent or largely but not necessarily wholly that which is specified. The terminology includes the above-listed words, derivatives thereof and words of similar import.

FIG. 1 illustrates a dual fluid cartridge assembly 30. The cartridge assembly 30 is adapted to be dispensed by way of a caulking gun 20, which includes a plunger (not visible in the figures), a handle 24, and a trigger 26. The cartridge assembly 30 is inserted into the caulking gun 20 in a conventional manner. As the trigger 26 is squeezed towards the handle 24, the plunger 22 advances in an axial direction A toward a distal end 28 of the cartridge assembly 30, assuming a ratchet arm 32*a* is in the position shown in FIG. 1. As will be discussed in more detail below, movement of the plunger 22 from a proximal end 27 of the cartridge assembly 30 toward the distal end 28 of the cartridge assembly 30 results in axial movement of an inner cartridge positioned within an outer cartridge of the cartridge assembly 30. The axial movement of the inner cartridge within the outer cartridge results in the dispensing and application of the fluids to a work piece by way of a cartridge outlet and a nozzle, such as a static mixing nozzle, in a similar manner as disclosed in U.S. Pat. No. 5,310,091, which is hereby incorporated by reference.

The cartridge assembly 30 may be provided with a vent path to atmosphere which allows air in the inner cartridge and optionally the outer cartridge to be evacuated to atmosphere during a filling process of the inner and outer cartridges to prevent trapped air pockets therein. Such trapped air pockets are known to result in voids in the fluid in the inner and outer cartridges resulting in non-homogeneous mixing of the fluids thereby decreasing the performance of the fluids.

Figure 2:
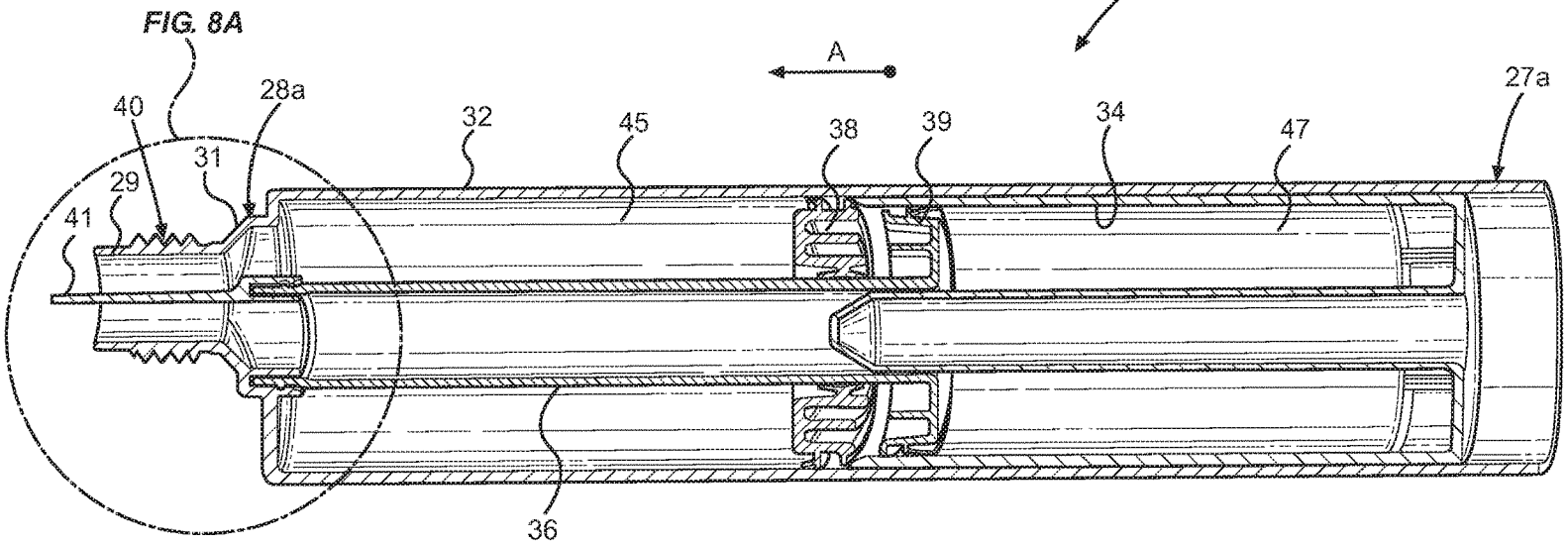
FIG. 2 illustrates a cross sectional view of the dual fluid cartridge assembly shown in FIG. 1 in a filled position taken along line 2-2.
Figure 3:
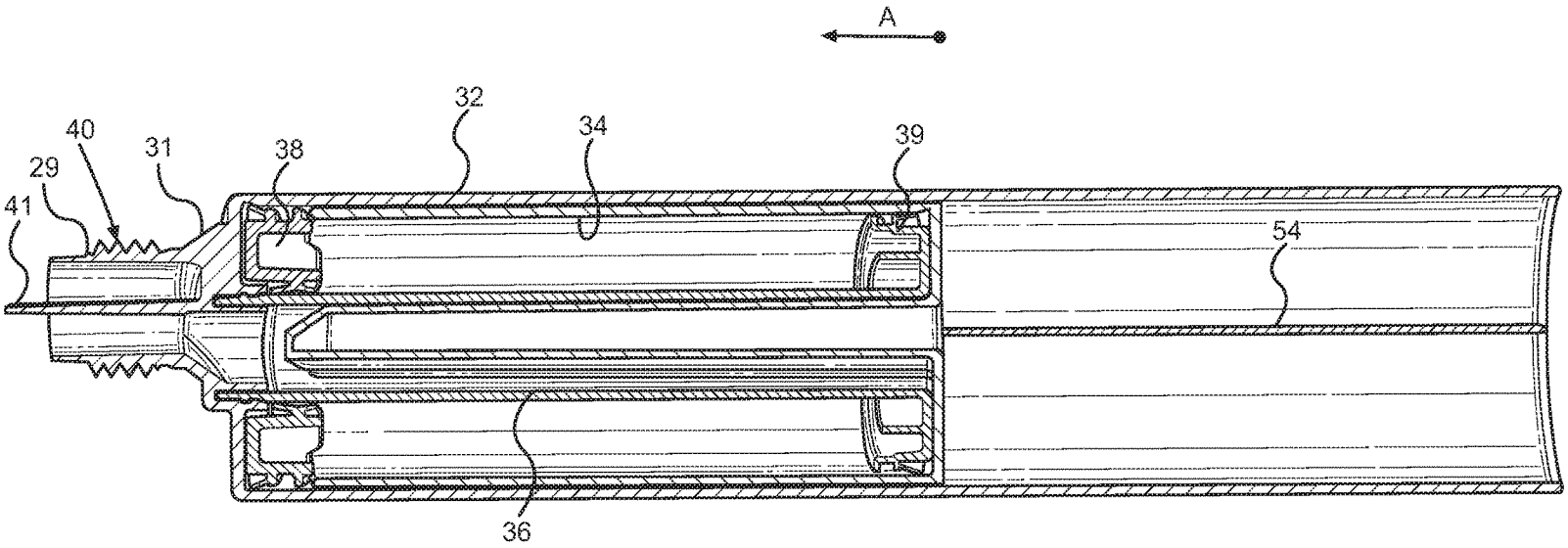
FIG. 3 illustrates another cross sectional view of the dual fluid cartridge assembly shown in FIG. 1 in an empty position taken along line 2-2.
Figure 4:
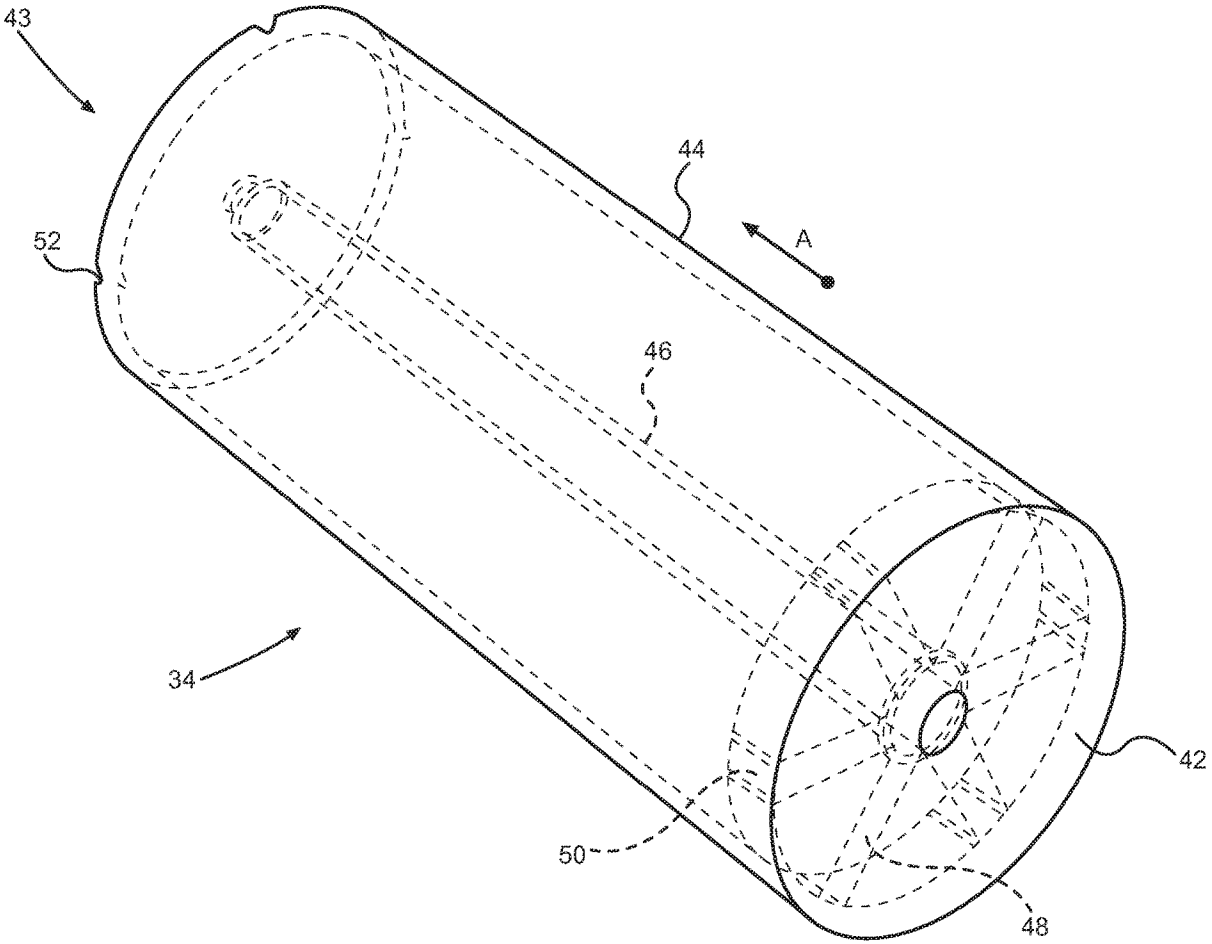
FIG. 4 is a partial simplified view of the air vent path formed in an inner cartridge.
Figure 5:
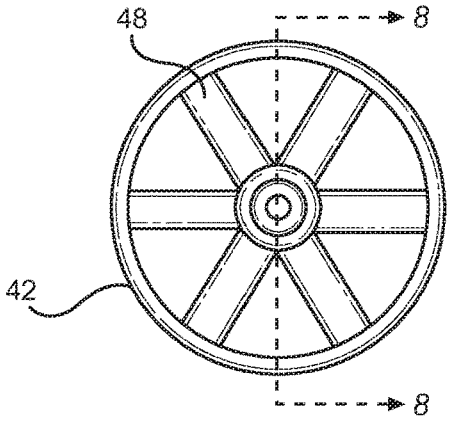
FIG. 5 is a right side view of the inner cartridge shown in FIG. 4.
Figure 6:
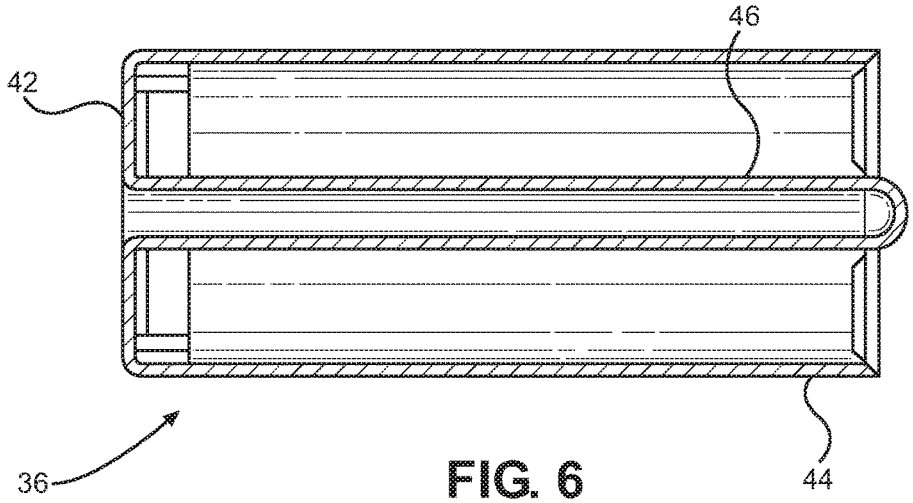
FIG. 6 is a sectional view of the inner cartridge taken along line 8-8 of FIG. 5.
Figure 7:
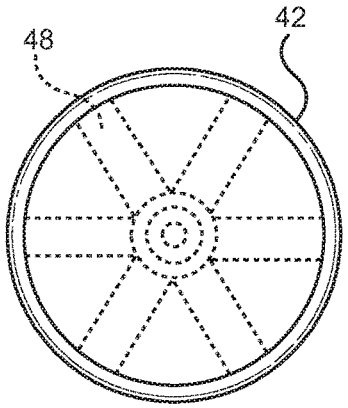
FIG. 7 is a left side view of the inner cartridge shown in FIG. 4.

FIGS. 2 and 3 illustrate cross sectional views of the cartridge assembly 30. The cartridge assembly 30 in FIG. 2 is in a filled position, while the cartridge assembly 30 in FIG. 3 is in an empty position. The cartridge assembly 30 includes an outer cartridge 32, an inner cartridge 34, an integral piston seal and piston tube 36 having a lower seal portion 39, and an upper seal 38.

A vent path to atmosphere may be provided from the inner cartridge 34 when the inner cartridge 34 is in an empty position, as illustrated in FIG. 3. Filling of the inner cartridge 34 may be done through a cartridge outlet 40. The cartridge outlet 40 includes a nose portion 29 and a shoulder portion 31. The nose portion 29 is distal to the shoulder portion 31 and is formed as a tubular member with an axial separator wall 41, which forms two side by side chambers for enabling filling of each of the fluids. In order to fill the inner cartridge 34, fluid is applied through the cartridge outlet 40 through the piston tube 36 into a back chamber 47 forming the inner cartridge 34. Similarly, a front chamber 45 formed within the outer cartridge 32 is also filled by way of the cartridge outlet 40.

FIGS. 4-7 illustrate the inner cartridge 34. The inner cartridge 34 includes a circular base plate 42 and a cylindrical sidewall 44. A rod 46 (also referred to as a "separator rod" or an "evacuation rod") projects distally from the base plate 42 and extends to a mouth 43 of the cylindrical sidewall 44 of the inner cartridge 34. The slots 48 are, for example, radial slots formed in the base plate 42 of the inner cartridge 34. The slots 48 formed in the base plate 42 of the inner cartridge 34 extend partially up the cylindrical sidewall 44 in the axial direction A, as indicated by the reference numeral 50. The slots 48 and 50 are configured to allow trapped air in the inner cartridge 34 to escape up along the cylindrical sidewall 44 of the inner cartridge 34 and bleed to the outside of the inner cartridge 34 by way of one or more notches 52 formed at the mouth 43 of the inner cartridge 34. One or more axial slots 54 (see FIG. 3) formed in an inner sidewall of the outer cartridge 32 allow the air from the inner cartridge 34 to escape through the axial slots 54 and out to atmosphere. As the lower seal portion 39 of the piston seal and piston tube 36 moves away from the empty position illustrated in FIG. 3, the vent path is closed. The lower seal portion 39 of the piston seal and piston tube 36 may be formed, for example, with a circumferential slot (not shown) for receiving and an O-ring (not shown). The lower seal portion 39 seals the fluid in the inner cartridge 34 from the rest of the cartridge assembly 30.

Figure 8A:
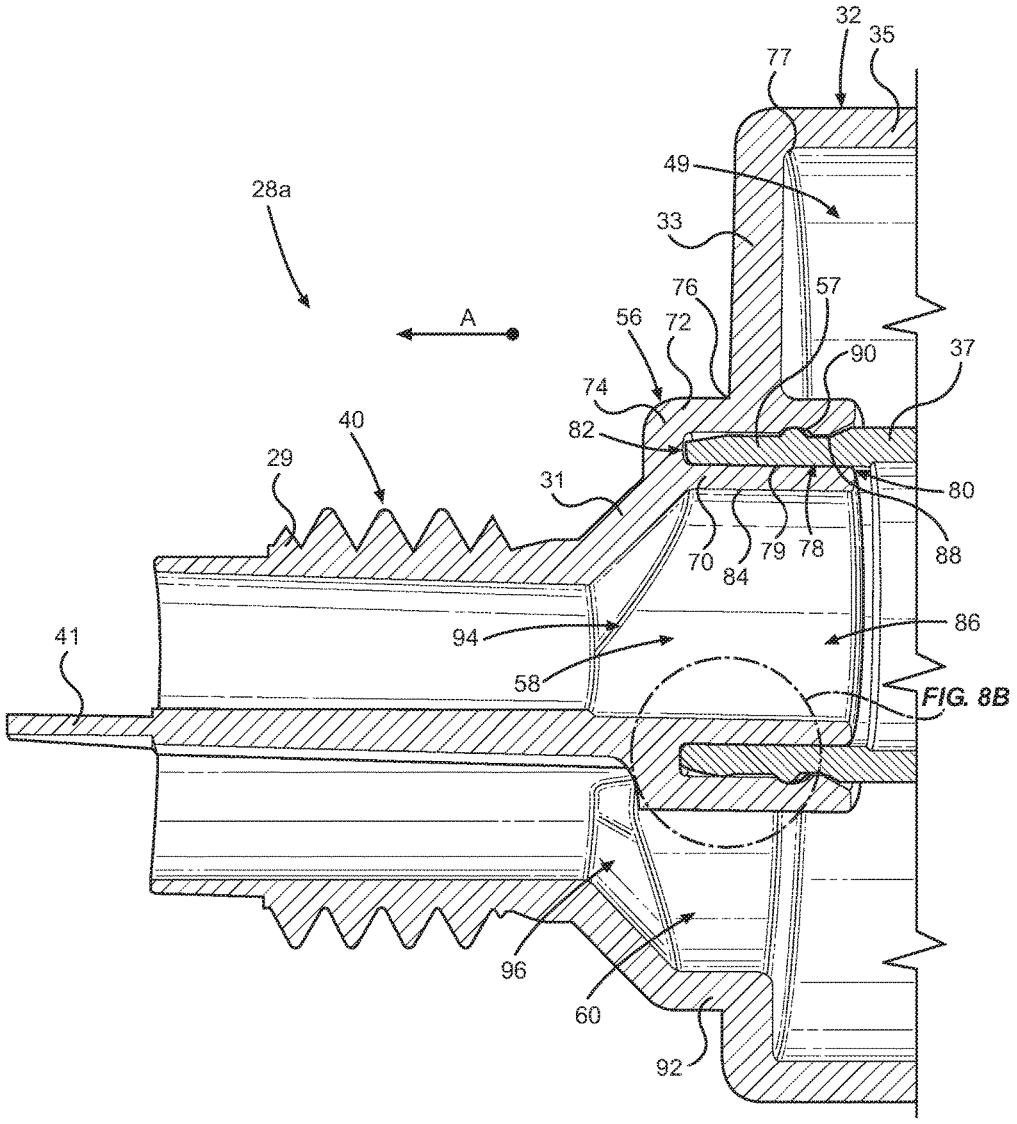
FIG. 8A is an enlarged detailed view of a cross section of the distal end of the dual fluid cartridge assembly shown in FIG. 2.

FIG. 8A illustrates a detailed cross sectional view of a distal end 28*a* of the outer cartridge 32 shown in FIG. 2. The outer cartridge 32 is formed as a cylindrical member having a base wall 33 and a cylindrical sidewall 35. The base wall 33 is positioned toward the distal end 28*a* of the outer cartridge 32 and extends in a radial direction inward from the cylindrical sidewall 35. The radial direction may be substantially perpendicular to the axial direction A. The base wall 33 has an outer edge 77 that extends about a perimeter of the base wall 33. The cylindrical sidewall 35 extends proximally from the outer edge 77 and defines a channel 49 that extends through the outer cartridge 32 from a proximal end 27*a* towards the distal end 28*a* (see FIG. 2). The cylindrical sidewall 35 has a diameter that is slightly larger than the diameter of inner cartridge 34 to allow free axial movement of the inner cartridge 34 within the channel 49.

The outer cartridge 32 may be coupled to or formed with the cartridge outlet 40 used for filling and dispensing the fluids from the inner cartridge 34 and the outer cartridge 32. The outer cartridge 32 includes a flange 56 for connection to the piston tube 36. The connection between the flange 56 and the piston tube 36 is to substantially prevent any fluid in the front chamber 45 or the back chamber 47 from mixing. In an aspect, the flange 56 is integrally formed with the outer cartridge 32 and adjacent to the base wall 33. The piston seal and piston tube 36 includes a delivery tube portion 37 and an extended end portion 57. The delivery tube portion 37 forms a conduit from the inner cartridge 34 to the cartridge outlet 40. The delivery tube portion 37 may have a cylindrical shape. Fluid in the inner cartridge 34 is dispensed through the delivery tube portion 37 through an inner opening 58 to the cartridge outlet 40. Fluid in the outer cartridge 32 is dispensed into an outer opening 60. Accordingly, the inner opening 58 and outer opening 60 formed along the base wall 33 of the outer cartridge 32 together with the axial separator wall 41 allow the fluid from the inner cartridge 34 and the outer cartridge 32 to be discharged side by side out of the cartridge outlet 40, respectively.

The flange 56 includes an inner flange wall 70, an outer flange wall 72, and a base flange wall 74 connecting the inner flange wall 70 to the outer flange wall 72. The flange 56 extends at least partially along an inner edge 76 of the base wall 33. The flange 56 may extend circumferentially about the axial direction A.

The inner flange wall 70, the outer flange wall 72, and the base flange wall 74 define a cavity 78 within the flange 56. The cavity 78 extends in the axial direction A from a cavity opening 80 to a cavity base 82. The cavity opening 80 opens to the channel 49 defined by the outer cartridge 32. The inner flange wall 70 has an inner flange surface 84 that extends circumferentially about the axial direction A to define the inner opening 58 and a flange channel 86. The inner flange wall 70 may be connected to the shoulder portion 31 of the cartridge outlet 40 and the axial separator wall 41. The flange channel 86 is in fluid communication with the inner opening 58 and the delivery tube portion 37, such that fluid that is dispensed from the inner cartridge 34 flows through the delivery tube portion 37, the flange channel 86, and the inner opening 58 to the cartridge outlet 40.

The cavity 78 is configured to receive the extended end portion 57 of the piston seal and piston tube 36 within. In an aspect, the extended end portion 57 may define at least one circumferential slot 88 that extends about the extended end portion 57. The flange 56 may define at least one mating slot 90 within the cavity 78. The at least one mating slot 90 may cooperate with the at least one circumferential slot 88. The cooperation between the at least one mating slot 90 and the at least one circumferential slot 88 may form a snap clip between the flange 56 and the piston tube 36. An adhesive may also be used to further secure the piston tube 36 within the cavity 78 of the flange 56.

The base flange wall 74 is positioned distal to the base wall 33, such that the flange 56 protrudes from the base wall 33 in the axial direction A. In an aspect, the cavity base 82 may also be positioned distal to the base wall 33 in the axial direction A, such that the cavity base 82 is external to the outer cartridge 32. When the piston tube 36 is positioned within the cavity 78, the extended end portion 57 may extend beyond the base wall 33 in the axial direction A. The extended end portion 57 may be adjacent to or in contact with the cavity base 82.

The cavity opening 80 may be positioned closer to the proximal end 27*a* of the outer cartridge 32 relative to the base wall 33, such that the base wall 33 is distal to the cavity opening 80 in the axial direction A. In this configuration, the base wall 33 is positioned between the cavity opening 80 and the cavity base 82 in the axial direction A. Alternatively, the cavity opening 80 may be coplanar or flush with the base wall 33.

The shoulder portion 31 of the cartridge outlet 40 may be attached to the flange 56 and to an axial shoulder 92. The axial shoulder 92 extends from the base wall 33 in the axial direction A. Alternatively, the shoulder portion 31 may be attached to the flange 56 and directly to the base wall 33. The shoulder portion 31 forms a portion of a first flow channel 94 and a portion of a second flow channel 96. The first flow channel 94 is in fluid communication with the inner opening 58, and the second flow channel 96 is in fluid communication with the outer opening 60. The shoulder portion 31 may be angularly offset from the axial direction A forming at least a partially conical shape.

In an aspect, each of the components of the cartridge assembly 30 may be integrally formed together to form a single structure, which may be formed from a single material or multiple materials. Alternatively, each of the components of the cartridge assembly 30 may be separate components that are coupled together, or some of the components may be integrally formed together to form a single structure that is coupled together with the other components.

In operation, the inner cartridge 34 may be filled with a first fluid by way of the cartridge outlet 40. In particular, a fill tube (not shown) may be inserted in the cartridge outlet 40 and into the inner opening 58. As discussed above, the inner opening 58 is in fluid communication with the delivery tube portion 37 of the piston tube 36, which, in turn, is in fluid communication with the inner cartridge 34. When the inner cartridge 34 is in the position shown if FIG. 3, the vent path is open to the atmosphere. In particular, in this position, as the first fluid fills the inner cartridge 34, air is pushed out of the rear of the outer cartridge 32. A cartridge assembly having a vent path with vent slots is described in U.S. Pat. No. 7,506,783, the content of which is incorporated herein by reference.

While the inner cartridge 34 is being filled with the first fluid, a force is applied to the piston tube 36 that pulls the piston tube 36 in a direction away from the flange 56. The force applied to the piston tube 36 includes, for example, a force of the first fluid on the inner cartridge 34 and a frictional force between the lower seal 38 and the delivery tube 36 as the inner cartridge 34 slides towards the distal end 27*a* of the outer cartridge 32. It will be appreciated that the back chamber 47 is filled with the first fluid before the front chamber 45 is filled with the second fluid or both the back chamber 47 and the front chamber 45 may be filled simultaneously. If the front chamber 45 is over filled, the lower seal 38 may contact the upper seal 39 applying an additional force to the piston tube 36. The force applied by the lower seal 38 may be up to or exceed 625 lbs. (e.g. a filling pressure of 300 psi in the front chamber 45). Each of the applied forces pulls the piston tube 36 away from the flange 56.

The cavity 78 extends from the cavity base 82 to the cavity opening 80 to an optimal distance to minimize the risk of the piston tube 36 being removed from the cavity 78 of the flange 56 during a fill operation. In an aspect, a distance between the cavity base 82 and the cavity opening 80 is at least 2.5 millimeters. Preferably, the distance between the cavity base 82 and the cavity opening 80 is at least 8 millimeters. The distance the cavity 78 extends provides an extra length of interface between the extended end portion 57 of the piston tube 36 and the cavity 78, which provides increased retention of the piston tube 36 within the cavity 78, additional length for improved or additional retention interface features between the extended end portion 57 and the cavity 78, and an option to improve fluid flow through the cartridge outlet 40 by increasing the size of the inner opening 58 and outer opening 60.

The distance between the cavity base 82 and the cavity opening 80 may also be related to a diameter of the flange 56. For example, the distance between the cavity base 82 and the cavity opening 80 may be selected based on a diameter of an inner surface 79 of the of the inner flange wall 70. The inner surface 79 defines at least a portion of the cavity 78. In an aspect, a ratio between the distance from the cavity base 82 and the cavity opening 80, and the diameter of the inner surface 79 is more than 0.19. In an alternative aspect, a ratio between the distance from the cavity base 82 and the cavity opening 80, and the diameter of the inner surface 79 is between 0.5 and 0.7. For example, if the diameter of the inner surface 79 is 10 millimeters, then the distance between the cavity base 82 and the cavity opening 80 should be between 5 millimeters and 7 millimeters. In a preferred aspect, the ratio between the distance from the cavity base 82 and the cavity opening 80, and the diameter of the inner surface 79 is between 0.6 and 0.65. In a further preferred aspect, the ratio between the distance from the cavity base 82 and the cavity opening 80, and the diameter of the inner surface 79 is 0.62.

Figure 8B:
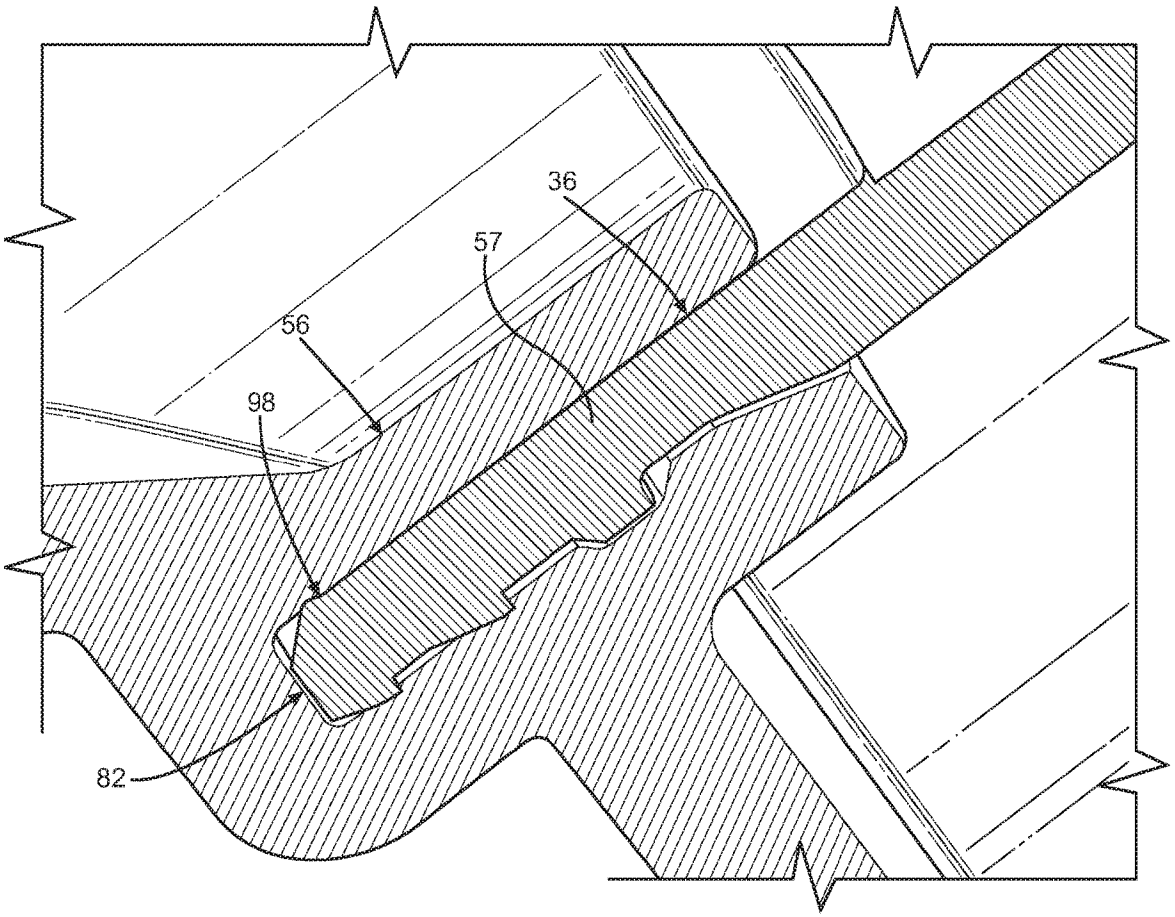
FIG. 8B is an enlarged detailed view of a cross section of the distal end of the dual fluid cartridge assembly shown in FIG. 8A.

FIG. 8B illustrates a detailed cross sectional view of the flange 56 with the extended end 57 of the piston tube 36 positioned within. The extended end 57 may include at least one seal bead 98. The seal bead 98 protrudes from the extended end 57 towards the flange 56. The seal bead 98 may contact the inner flange wall 70, the outer flange wall 72, and/or the base flange wall 74. In an aspect, the seal bead 98 may be positioned towards a distal end of the extended end 57. The contact between the seal bead 98 and the flange 56 may substantially prevent fluid in the front chamber 45 and the back chamber 47 from mixing.

Figure 9:
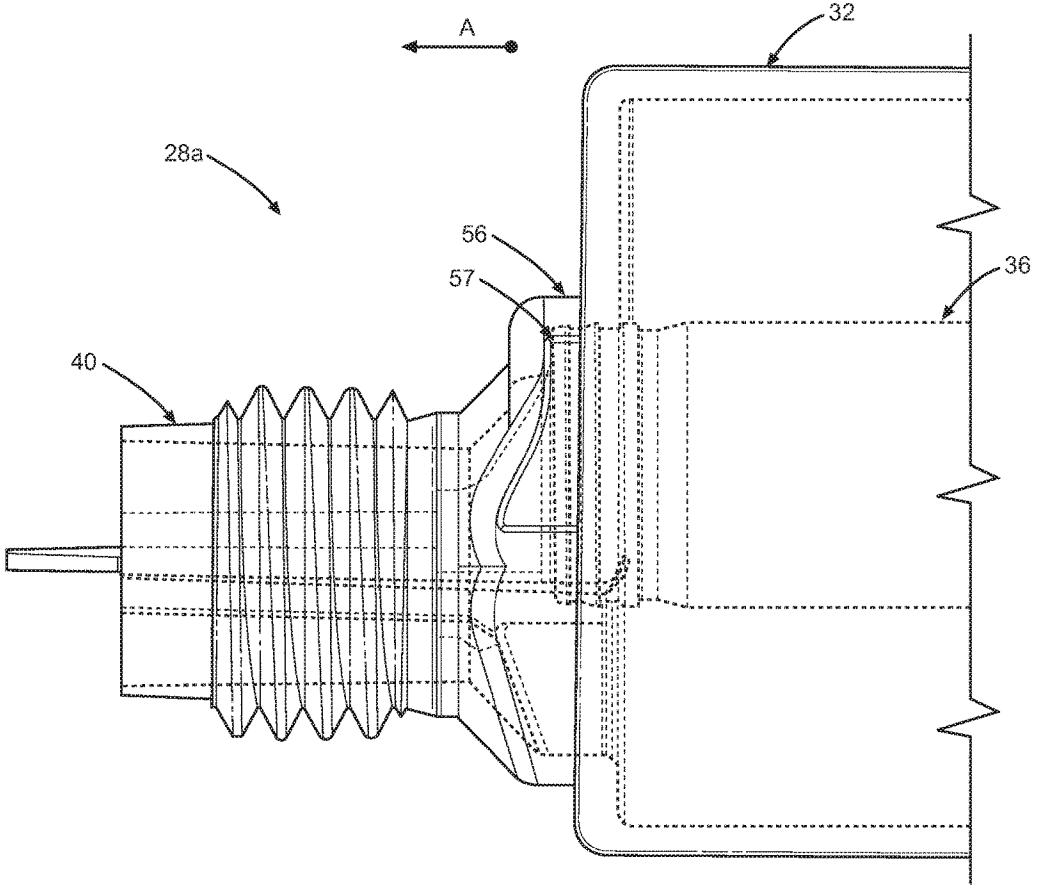
FIG. 9 is an enlarged, partially transparent view of the distal end of the dual fluid cartridge assembly.

FIG. 9 illustrates a partially transparent view of the distal end 28*a* of the outer cartridge 32. The flange 56 comprises a translucent material, such as polypropylene. The translucent material may allow a person or a vision system to see at least partially through the flange 56 and into the cavity 78. The piston tube 36 may comprise an opaque material. The material of the piston tube 36 is a different color than the color of the flange 56. Moreover, it is preferred that the color of the material of the piston tube 36 be different from the colors of the fluids within the chambers 45 and 47. When the extended end portion 57 of the piston tube 36 is positioned within the cavity 78, a person or vision system positioned externally to the cartridge assembly 30 may see the piston tube 36 within the cavity 78. If the piston tube 36 is detached from the flange 56, then the person or vision system positioned externally to the cartridge assembly 30 may see that the piston tube 36 is detached. Viewing the piston tube 36 within the cartridge assembly 30 provides a quick way of assessing whether the cartridge assembly 30 is fully intact without the need for more complex or invasive tests. It will be appreciated that the other components of the outer cartridge 32 may comprise a translucent material, including the base wall 33 and the cylindrical sidewall 35.

In an aspect, the outer flange wall 72 and/or the base flange wall 74 may have a thin thickness. For example, a thickness of the outer flange wall 72 and the base flange wall 74 may be less than a thickness of the base wall 33 of the outer cartridge 32. The thin thickness of the outer flange wall 72 and/or the base flange wall 74 may increase the visibility of the presence of the piston tube 36 within the cavity 78 by a person or a vision system.

After the inner cartridge 34 is filled with the first fluid, the outer cartridge 32 may be filled with a second fluid. The outer cartridge 32 is also filled through the cartridge outlet 40, but through the outer opening 60. After the inner cartridge 34 and the outer cartridge 32 are filled, a person or vision system can inspect the flange 56 to verify that the piston tube 36 has not detached from the outer cartridge 32. A cap (not shown) may be used to close the cartridge out 40 of the cartridge assembly 30.

The fluids in the cartridge assembly 30 may then be dispensed by way of a caulking gun 20, as shown in FIG. 1. In operation, as the plunger 22 advances in the axial direction A toward the distal end 28 of the cartridge assembly 30, the inner cartridge 34 moves in the axial direction A toward the cartridge outlet 40. As the inner cartridge 34 advances in the axial direction A, the first fluid from the inner cartridge 34 is forced into the piston tube 36 and to the cartridge outlet 40 through the flange channel 86, inner opening 58, and the first flow channel 94. As the inner cartridge 34 advances in the axial direction A, the upper seal 38 advances in the axial direction A toward the cartridge outlet 40. Initially, the upper seal 38 and the lower seal portion 39 are side by side when the cartridge assembly 30 is full. However, as the inner cartridge 34 advances in the axial direction A, the inner cartridge 34 pushes the upper seal 38 in the axial direction A, which forces the second fluid in the outer cartridge 32 to be dispensed out the cartridge outlet 40 through the outer opening 60 and the second flow channel 96.

It will be appreciated that the foregoing description provides examples of the disclosed system and method. However, it is contemplated that other implementations of the disclosure may differ in detail from the foregoing examples. All references to the disclosure or examples thereof are intended to reference the particular example being discussed at that point and are not intended to imply any limitation as to the scope of the disclosure more generally. All language of distinction and disparagement with respect to certain features is intended to indicate a lack of preference for those features, but not to exclude such from the scope of the disclosure entirely unless otherwise indicated.

What is claimed is:

1. A dual fluid cartridge assembly, comprising:

an outer cartridge that extends in an axial direction from a proximal end to a distal end, the outer cartridge comprising:

a base wall having an inner edge, the base wall being positioned toward the distal end of the outer cartridge; and a flange extending at least partially along the inner edge of the base wall, the flange defining a cavity that extends in the axial direction from a cavity opening to a cavity base, wherein the cavity base is distal to the base wall in the axial direction; and a piston tube having an extended end positioned within the cavity.

2. The dual fluid cartridge assembly of claim 1, wherein the base wall has an outer edge, and wherein the outer cartridge further comprises an outer wall that extends from the outer edge of the base wall in a direction opposing the axial direction.

3. The dual fluid cartridge assembly of claim 2, wherein the outer wall defines a channel, and wherein the piston tube is positioned at least partially within the channel.

4. The dual fluid cartridge assembly of claim 3, wherein the flange includes an inner flange wall, an outer flange wall, and a base flange wall connecting the inner flange wall to the outer flange wall, wherein the inner flange wall, the outer flange wall, and the base flange wall define the cavity within the flange.

5. The dual fluid cartridge assembly of claim 4, wherein the inner flange wall has an inner flange surface that defines a flange channel that extends through the flange in the axial direction, wherein the flange channel is in fluid communication with the piston tube.

6. The dual fluid cartridge assembly of claim 1, wherein the cavity further extends circumferentially about the axial direction.

7. The dual fluid cartridge assembly of claim 1, wherein the cavity extends from the cavity base to the cavity opening to a distance of at least 2.5 millimeters.

8. The dual fluid cartridge assembly of claim 1, wherein a ratio between a distance from the cavity base to the cavity opening and a diameter of an inner surface of the flange is more than 0.19.

9. The dual fluid cartridge assembly of claim 1, wherein the extended end of the piston tube defines at least one circumferential slot, and wherein the flange defines at least one mating slot within the cavity, and wherein the at least one mating slot is configured to cooperate with the at least one circumferential slot.

10. The dual fluid cartridge assembly of claim 1, wherein the base wall is distal to the cavity opening in the axial direction.

11. The dual fluid cartridge assembly of claim 1, wherein the flange comprises a translucent material.

12. The dual fluid cartridge assembly of claim 1, wherein the extended end of the piston tube is visible through the flange.

13. A dual fluid cartridge assembly, comprising:

an outer cartridge that extends in an axial direction from a proximal end to a distal end, the outer cartridge comprising:

a base wall having an inner edge that defines a cartridge outlet, and a flange extending at least partially along the inner edge of the base wall, the flange defining a cavity that extends in the axial direction from a cavity opening to a cavity base, wherein the base wall is distal to the cavity opening in the axial direction, and wherein the cavity base is distal to the base wall in the axial direction; and a piston tube having an extended end positioned within the cavity.

14. The dual fluid cartridge assembly of claim 13, wherein the axial direction is a first axial direction, and wherein the base wall has an outer edge, and wherein the outer cartridge further comprises an outer wall that extends from the outer edge of the base wall in a second axial direction, wherein the second axial direction opposes the first axial direction.

15. The dual fluid cartridge assembly of claim 14, wherein the outer wall defines a channel, and wherein the piston tube is positioned at least partially within the channel.

16. The dual fluid cartridge assembly of claim 15, wherein the flange includes an inner flange wall, an outer flange wall, and a base flange wall connecting the inner flange wall to the outer flange wall, wherein the inner flange wall, outer flange wall, and the base flange wall define the cavity within the flange.

17. The dual fluid cartridge assembly of claim 16, wherein the inner flange at least partially defines the cartridge outlet.

18. The dual fluid cartridge assembly of claim 14, and wherein the extended end of the piston tube defines at least one circumferential slot, and wherein the flange defines at least one mating slot within the cavity, and wherein the at least one mating slot is configured to cooperate with the at least one circumferential slot.

19. The dual fluid cartridge assembly of claim 14, wherein the flange comprises a translucent material.

20. A dual fluid cartridge assembly, comprising:

a cartridge defining a channel;

a flange coupled to the cartridge, the flange defining a cavity that extends from a cavity opening to a cavity base, the cavity opening being positioned within the channel of the cartridge, the cavity base being positioned external to the cartridge; and a piston tube having an extended end, the piston tube being positioned at least partially within the channel, and the extended end being positioned within the cavity.

21. A dual fluid cartridge assembly, comprising:

an outer cartridge for carrying a first fluid, the outer cartridge comprising:

a cylindrical outer wall that defines a channel, a base wall having an inner edge that defines a cartridge outlet, and a flange extending at least partially along the inner edge of the base wall, the flange defining a cavity that extends in an axial direction from a cavity opening to a cavity base, wherein the base wall is distal to the cavity opening in the axial direction, and wherein the cavity base is distal to the base wall in the axial direction;

an upper seal positioned within the channel, the upper seal configured to seal said first fluid in said outer cartridge;

an inner cartridge for carrying a second fluid; and a piston tube having an extended end, the piston tube being positioned at least partially within the channel, and the extended end being positioned within the cavity, the piston tube configured to provide a fluid flow path from said inner cartridge to said cartridge outlet.

* * * * *